United States Patent [19]

Rowe

[11] Patent Number: 4,666,282

[45] Date of Patent: May 19, 1987

[54] CONTAMINATION CONTROL FOR XEROGRAPHIC DEVELOPING SYSTEMS

[75] Inventor: Paul J. Rowe, Williamson, N.Y.

[73] Assignee: Xerox Corporation, Stamford, Conn.

[21] Appl. No.: 836,680

[22] Filed: Mar. 3, 1986

[51] Int. Cl.[4] ..... G03G 15/08

[52] U.S. Cl. ..... 355/3 DD; 355/14 D; 355/15; 430/120; 118/652; 15/301

[58] Field of Search ..... 355/15, 3 DD, 140, 3 R; 15/300 R, 301, 345, 347, 357, 256.51, 256.52; 55/97, 266, 309, 312, 313, 314, 410, 418, 419, 424; 118/652; 430/120

[56] References Cited

U.S. PATENT DOCUMENTS

| | | | |
|---|---|---|---|
| 3,534,427 | 10/1970 | Severynse | 15/301 |
| 3,932,910 | 1/1976 | Shimoda | 15/301 |
| 3,969,785 | 7/1976 | Ogawa et al. | 15/301 |
| 4,093,369 | 6/1978 | Hewitt | 355/15 |
| 4,121,947 | 10/1978 | Hemphill | 15/301 X |
| 4,142,269 | 3/1979 | Seeberger | 15/301 X |
| 4,583,112 | 4/1986 | Morano et al. | 355/3 DD |

FOREIGN PATENT DOCUMENTS

100246-A of 1984 European Pat. Off. .

*Primary Examiner*—A. C. Prescott

*Attorney, Agent, or Firm*—Frederick E. McMullen

[57] ABSTRACT

To control pressures in the developer housing of a xerographic machine, a fan with inlet connected to the housing interior through a particulate filter is used. To reduce the effect of filter loading, a mixing chamber is interposed having a fresh air inlet, the dimension of which is substantially greater than the passage from the developer housing so that as the pressure drop across the filter rises as the filter traps more and more particles, the flow of contaminated air from the developer housing remains substantially constant.

4 Claims, 4 Drawing Figures

CONTAMINATION CONTROL FOR XEROGRAPHIC DEVELOPING SYSTEMS

The invention relates to xerographic type copying and printing machines, and more particularly, to an improved contamination control for such machines.

In xerographic type copying and printing machines, the electrostatic latent images, which are derived from a document original or from electrical signals or pixels, are formed on the machine recording member. Thereafter the images are developed and transferred to a suitable copy substrate material. Following transfer, the images are fixed or fused to provide a permanent copy. In machines of this type, a dry power, commonly referred to as toner, is used to develop the images. Because toner is a powder, the interior of the machine developer housing normally becomes contaminated with particles of toner dust and dirt. To prevent the escape of this particulate material into adjoining areas of the machine or even to points outside the machine, the developer housing is normally sealed insofar as possible against leakage. However, operation and use of the machine normally creates a pressure rise within the developer housing which if not relieved, forces the particles past the seals and out of the confines of the developer housing into other areas.

The prior art has dealt with this problem by regulating pressures within the developer housing itself with the aim of preventing interior pressures from rising to a point where contaminated air from the developer housing interior is driven past the seals. Regulation of this type is typically effected by bleeding air from the housing. To prevent the air which is usually contaminated with particles of dirt and dust from carrying the particles with it to the outside, a filter is provided to filter the air prior to discharge so that only clean air is discharged. However, the interval before the filter becomes obstructed or partially obstructed is often very short, and when this happens, the flow of air from the developer housing drops with attendant rise in pressure within the developer housing.

In one prior art arrangement shown in U.S. Pat. No. 3,932,910 to Shimoda, material removed from a photoreceptor by a cleaning brush is passed through a filter bag under the influence of a fan. A gap is provided at the point where the filter is attached to assure that air is drawn into and not exhausted through the filter connection. In European Patent Document No. 100-246, a suction tube similar to those provided with household vacuum cleaners is used to remove powder from a magnetic drum, the suction tube being coupled to a source of vacuum for this purpose.

In contrast, the present invention provides, in a developer system for a xerographic machine, a housing with a sump for developer; at least one magnetic brush in the housing having a rotatable sleeve for bringing developer from the sump into developing relation with a recording member; fan means for drawing air from the developer housing to control internal pressures within the housing; a filter for trapping and removing particulate material carried with the air; a mixing chamber upstream of the filter; first air passage means communicating the developer housing with the mixing chamber; and second air passage means communicating the mixing chamber with a supply of fresh air, the second air passage means being substantially larger than the first air passage means to assure that a substantially greater proportion of fresh air is drawn through the filter than air from the developer housing so that as air flow through the filter is reduced by entrapment of particulate material in the filter, the amount of air from the developer housing passing through the filter remains substantially constant while the amount of fresh air passing through the filter is decreased.

IN THE DRAWINGS

Figure 1:
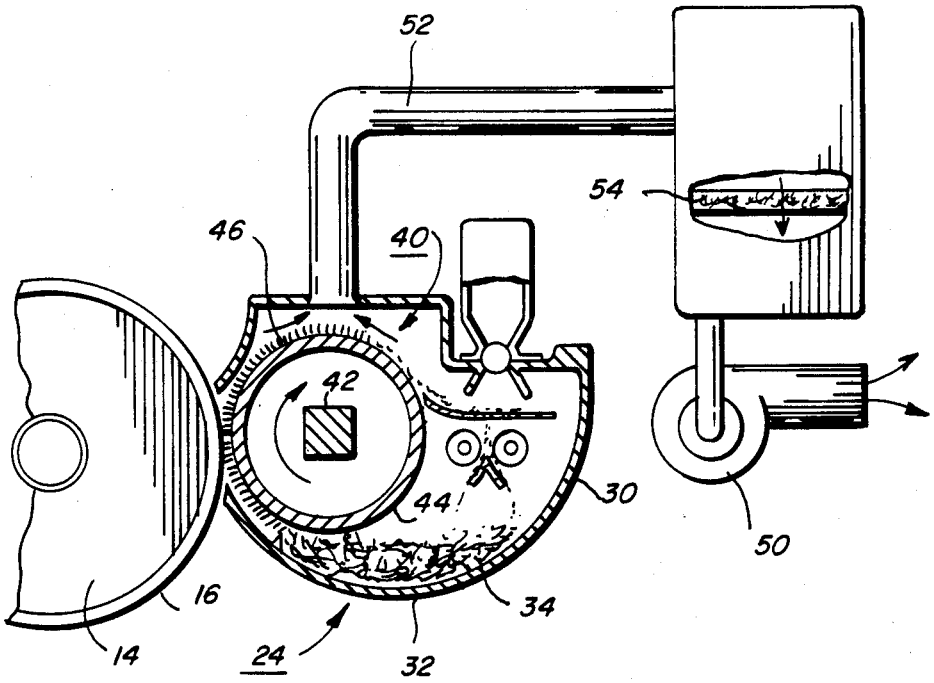
FIG. 1 is a schematic view of a developer housing for a xerographic type copying or printing machine depicting a typical system for controlling developer housing pressures by exhausting contaminated air from the housing interior.

Referring to FIG. 1 of the drawings, there is shown an exemplary developing system of a xerographic type copying or printing machine. Briefly, and as will be familiar to those skilled in the art, the machine xerographic components include a recording member, shown here in the form of a rotatable photoreceptor 14. In the arrangement shown, photoreceptor 14 comprises a drum having a photoconductive surface 16. Other photoreceptor types such as belt, web, etc. may instead be contemplated. Operatively disposed about the periphery of photoreceptor 14 as will be understood by those skilled in this art are a charging station where a uniform charge is placed on the photoconductive surface 16 of photoreceptor 14, an exposure station where the previously charged photoconductive surface 16 is exposed to image rays creating a latent electrostatic image on surface 16, a development station 24 where the latent electrostatic image created on photoconductive surface 16 is developed by toner, a transfer station where the developed image is transferred to a suitable copy substrate material such as a copy sheet brought forward in timed relation with the developed image on photoconductive surface 16, and a cleaning station where the photoconductive surface 16 is cleaned preparatory to charging. Following transfer, the developed image is fused or fixed to provide a permanent copy.

The image rays may be derived from a document original in which case a suitable viewing station with transparent platen would typically be provided for supporting the document original while the document original is converted to image rays as for example by scanning. The image rays are transmitted to the exposure station by a suitable optical system. Alternately, the image may be in the form of image signals or pixels such as obtained from a raster input scanner, communication channel, memory, etc. The image signals for example may be employed to modulate a scanning beam of high intensity such as a laser that is swept across the photoconductive surface 16 as by a multi-faceted polygon in synchronism with the movement of the photoreceptor 14 to expose the previously charged photoconductive surface 16 line by line to create a latent electrostatic image thereon.

At developing station 24, a developer housing 30 has a lower portion which forms a sump 32 for holding a quantity of developer 34. As will be understood by those skilled in the art, developer 34 comprises a mixture of larger carrier particles and smaller toner or ink particles, commonly referred as two component developer. Alternately, a unitary developer mixture commonly referred to as single component developer, may be used.

A magnetic brush type developer roll 40 is provided in developer housing 30, the length of developer roll being equal to or slightly greater than the width of photoconductive surface 16, with the axis of roll 40 paralleling the axis of photoreceptor 14. Developer roll 40 has a relatively stationary magnet assembly 42 disposed within a rotatable cylinder or sleeve 44 of suitable non-magnetic material. Sleeve 44 is rotatably journaled for rotation in the opposing sides of developer housing 30. Magnet assembly 42 is arranged so that as sleeve 44 rotates, developer in sump 32 is attracted to the exterior surface of sleeve 44 to form a brush-like covering 46 on sleeve 44. Rotation of sleeve 44 carries the developer brush 46 into developing ralation with the photoconductive surface 16 of photoreceptor 14 to develop the latent electrostatic image thereon. While a single developer roll 40 is shown, multiple developer rolls may be contemplated.

As will be understood, toner is a dry powder-like substance, and hence the interior of developer housing 30 tends to become dirty and dusty during use of the machine. This is exacerbated by any moving parts in the developer housing such as sleeve 44 of developer roll 40, shafts, mixing augers, etc. To prevent particulate material such as toner dust, dirt, and the like from escaping from developer housing 30 and contaminating other areas of the machine such as the photoreceptor area, or from escaping to the machine exterior, the developer housing is normally sealed. However, an air tight seal is difficult to achieve and maintain, particularly at the points where moving members such as shafts enter the developer housing or at the juncture between the moving photoreceptor 14 and the stationary developer housing. And sealing the developer housing tends to allow pressures resulting from operation of the machine to build up within the housing interior which in turn tends to force contaminated air through the seals and into adjoining areas of the machine.

To control pressure conditions within a developer housing and prevent excess pressures from being developed therewithin, a developer housing air exhaust system is typically provided. In FIG. 1, an exhaust fan 50 is used for this purpose, the inlet to fan 50 communicating with the interior of developer housing 30 as by a suitable passage or passages, represented here by exhaust duct 52. Fan 50 discharges to a suitable discharge area, as for example, the exterior of the machine. To prevent particulate material such as toner dust, dirt, etc. from being exhausted with the air, a suitable filter 54 is provided upstream of fan 50 to trap particulates so that only clean air is exhausted.

However, in use, as more and more particulate material becomes trapped in filter 54 and filter 54 begins to be obstructed, the pressure drop across filter 54 increases. This reduces in air flow through filter 54, allowing pressure within developer housing 30 to rise and increasing the tendency of the contaminated air in developer housing 30 to escape.

Figure 2:
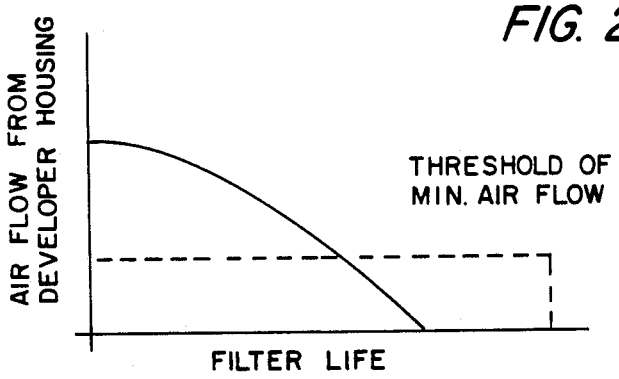
FIG. 2 is a graph depicting the relation between filter degradation and air flow for the system shown in FIG. 1.

As shown in FIG. 2, the amount of particulate material trapped by filter 54 bears a direct relation to the pressure drop across filter 54. That is, the greater the amount of particulates trapped by filter 54, the greater the pressure drop. The increased pressure drop in turn reduces the amount of air flow from developer housing 30. To compensate for this, developer housing exhaust systems of the type described are typically designed for higher air flows than are actually needed. Unfortunately, this usually causes filter 54 to fill up faster due to the increased flow of air passing through the filter.

Figure 3:
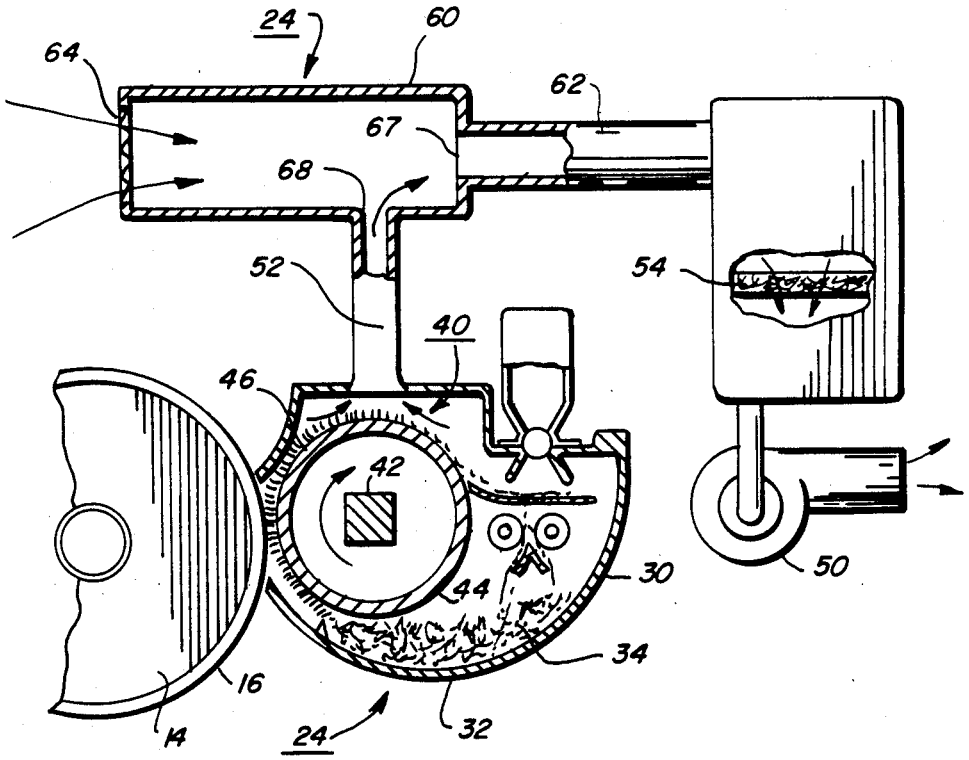
FIG. 3 is a schematic view of the developer housing of the present invention in which a contamination control is provided to maintain the amount of contaminated air exhausted substantially constant despite degradation of the filter.

Referring now to FIG. 3 of the drawings, where like numerals refer to like parts, the present invention provides a mixing chamber 60 having a relatively large fresh air inlet 64 in one side thereof. Inlet 64 communicates with a suitable source of fresh or clean air such as the machine exterior. Air outlet 67 at the opposite side of mixing chamber 60 communicates with the inlet of filter 54 by suitable means such as duct 62. Exhaust duct 52 communicates the interior of developer housing 30 with a contaminated air inlet 68 in mixing chamber 60, contaminated air inlet 68 being located at a suitable point between the fresh air inlet 64 and the air outlet 67.

The dimension of fresh air inlet 64 is substantially greater than the dimension of contaminated air inlet 68. In one system, a ratio of 15 to 1 was found to be suitable. However, other suitable ratios may be envisioned, particularly in the understanding that the ratio selected is dependent upon the design and operating parameters of the particular machine to which the teachings of the invention are applied. As a result, the amount of fresh air drawn into mixing chamber 60 and exhausted through filter 54 is normally greater than the amount of contaminated air drawn from the interior of developer housing 30.

Figure 4:
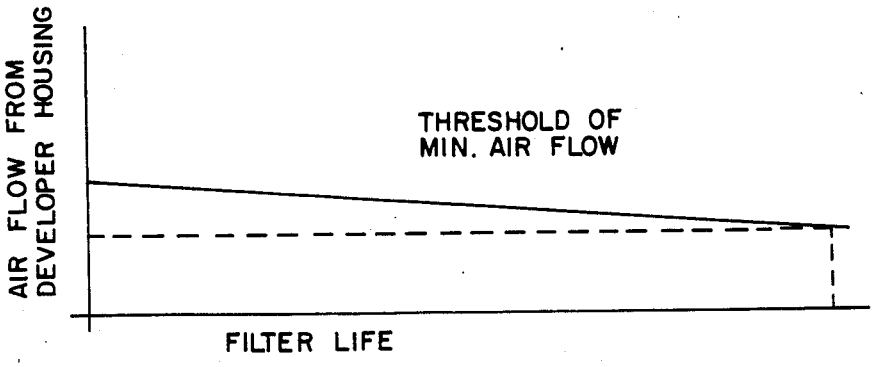
FIG. 4 is a graph depicting the relation between filter degradation and air flow for the contamination control of the present invention.

Referring to FIGS. 3 and 4, during operation of the machine, the natural pumping action of sleeve 44 of developer roll 40 is relied on to pump contaminated air from developer housing 30 through exhaust duct 52 to mixing chamber 60. There, the contaminated air mixes with the stream of fresh air drawn through fresh air inlet 64 and the mixture passes through filter 54 to fan 50 and is discharged through fan 50. Since the impedance of filter 54 to the clean air is significantly less than that of the contaminated air and since the quantity of fresh air is substantially greater than the quantity of contaminated air, any reduction in air flow resulting from the degradation or obstruction of filter 54 wll be compensated primarily by a reduction in flow of clean air. As a result, the flow of contaminated air from the developer housing is substantially independent of the loading or condition of flter 54 as demonstrated in Figure 4. This permits air fow from the developer housing to be kept to a minimum which in turn increases the life of filter 54.

While the invention has been described with reference to the structure disclosed, it is not confined to the details set forth, but is intended to cover such modifications or changes as may come within the scope of the following claims.

I claim:

1. In a developer system for a xerographic machine having a housing with a sump for developer, and at least one magnetic brush in the housing for bringing developer from the sump into developing relation with a recording member, said magnetic brush including a rotatable sleeve in operative juxtaposition with said recording member, the combination of:

(a) fan means for exhausting air from said developer housing;
(b) a filter for trapping and removing particulate material from said air prior to discharging of said air by said fan means;
(c) mixing chamber for said air upstream of said filter;
(d) first passage means communicating said developer housing with said mixing chamber; and
(e) second passage means communicating said mixing chamber with a source of fresh air;
(f) said second passage means being substantially larger than said first passage means so that a substantially greater proportion of fresh air is drawn through said filter than air from said developer housing whereby as the flow of air through said filter is reduced by particulate material trapped by said filter, the amount of air drawn from said developer housing remains substantially constant while the amount of fresh air decreases.

2. The developer system according to claim 1 in which the quantity of fresh air is approximately fifteen times the quantity of air drawn from said developer housing.

3. Means for maintaining the flow of contaminated air from the developer housing of a xerographic system despite increases in the pressure drop across a particulate filter through which the contaminated air passes prior to discharge, comprising in combination:
(a) a mixing chamber upstream of said filter;
(b) means coupling a first inlet of said chamber with a source of fresh air;
(c) means coupling a second inlet of said mixing chamber with said developer housing;
(d) means coupling a discharge outlet of said mixing chamber with said filter;
(e) said first inlet being substantially larger than said second inlet to provide a larger amount of fresh air to said mixing chamber than contaminated air from said developer housing so that, as the pressure drop across said filter increases as particles are trapped by said filter, reduction in the amounts of fresh and contaminated air through said filter is in proportion to the ratio of said inlet to said second inlet whereby reduction in the amount of contaminated air withdrawn from said developer housing is minimized.

4. The means according to claim 3 including fan means for drawing fresh and contaminated air through said mixing chamber and said filter for discharge.

* * * * *